US009156085B2

(12) United States Patent
Zammattio

(10) Patent No.: US 9,156,085 B2
(45) Date of Patent: Oct. 13, 2015

(54) DIE CASTING MACHINE WITH L-SHAPE FRAME

(71) Applicant: SUZHOU ORANGE DIECASTING CO., LTD., Jiangsu (CN)

(72) Inventor: Giacomo Zammattio, Jiangsu (CN)

(73) Assignee: SUZHOU DIECASTING CO., LTD., Jiangsu (CN)

( * ) Notice: Subject to any disclaimer, the term of this patent is extended or adjusted under 35 U.S.C. 154(b) by 0 days.

(21) Appl. No.: 14/473,255

(22) Filed: Aug. 29, 2014

(65) Prior Publication Data

US 2015/0060004 A1 Mar. 5, 2015

(30) Foreign Application Priority Data

Aug. 30, 2013 (CN) ..... 2013 1 0386859

(51) Int. Cl.

| | |
|---|---|
| ***B22D 17/10*** | (2006.01) |
| ***B22D 17/22*** | (2006.01) |
| ***B22D 17/26*** | (2006.01) |
| ***B22D 17/00*** | (2006.01) |

(52) U.S. Cl.

CPC ..... *B22D 17/002* (2013.01); *B22D 17/10* (2013.01); *B22D 17/22* (2013.01); *B22D 17/26* (2013.01); *B22D 17/266* (2013.01)

(58) Field of Classification Search

CPC ..... B22D 17/002; B22D 17/10; B22D 17/22; B22D 17/26; B22D 17/266; B29C 45/1761; B29C 2045/1762; B29C 2045/1763

USPC ..... 164/113, 137, 339, 342, 343

See application file for complete search history.

(56) References Cited

U.S. PATENT DOCUMENTS

| | | | | |
|---|---|---|---|---|
| 2,220,776 | A | 11/1940 | Smith | |
| 5,332,385 | A * | 7/1994 | Leonhartsberger | 425/589 |
| 5,861,181 | A * | 1/1999 | Thomas et al. | 425/188 |
| 6,824,382 | B2 * | 11/2004 | Ganz | 425/589 |
| 7,857,612 | B2 * | 12/2010 | Teng et al. | 425/472 |
| 2001/0052402 | A1 | 12/2001 | Mortari | |

FOREIGN PATENT DOCUMENTS

| | | | |
|---|---|---|---|
| CN | 100563989 | C | 12/2009 |
| DE | 102006014039 | A1 | 10/2006 |

OTHER PUBLICATIONS

Jan. 23, 2015 Extended Search Report issued in European Patent Application No. 14182887.1.

* cited by examiner

*Primary Examiner* — Kevin E Yoon
(74) *Attorney, Agent, or Firm* — Oliff PLC

(57) ABSTRACT

The invention discloses die casting machine with L-shape frame, including at least one L-shape frame, fixed die plate, fixed on end of upward extending side of frame, moving die device, disposed on other side of frame and slidable relative to frame, including moving die plate opposite to fixed die plate, lockable to frame by mold clamping device; a notch, formed on bottom of frame, first deformation compensation device, provided in notch, adapted for applying forces in opposite directions on sides of notch, while moving die plate is clamped with fixed die plate. First deformation compensation device of the present invention is adapted to applying forces on sides of the notch in lower position of the frame, to compensate squeeze to central section on the bottom of frame, weakening elastic distortion of the track on the frame, and eliminates effects of die casting or injection molding products due to deformation.

20 Claims, 10 Drawing Sheets

DIE CASTING MACHINE WITH L-SHAPE FRAME

CROSS-REFERENCE TO RELATED APPLICATIONS

Pursuant to 35 U.S.C. §119 and the Paris Convention Treaty, this application claims the benefit of Chinese Patent Application No. 201310386859.6 filed on Aug. 30, 2013, the contents of which are incorporated herein by reference.

BACKGROUND OF THE INVENTION

1. Field of the Invention

The present invention relates to the technical field of die casting, particularly relates to a die casting machine with L-shape frame.

2. Description of the Related Art

When producing products by injection molding or die casting technology, the first thing is to assembly a moving die and a fixed die to form a die cavity of product, then inject molten material into the die cavity, and form the product under certain pressure. During the process of injecting material or forming by compressing, distortion will be caused in moving die and fixed die, said distortion leads to a change of original shape of the die cavity, and eventually leads to a change of injection molding products or die casting products, even produces substandard products, seriously affect productivity, and increases production cost. For this purpose, special attentions have been paid by relevant technical staff to solve the distortion problem during the process of injection material or pressing forming.

The traditional solution to solve the deformation problem that caused in injection molding process is mainly focus on how to compensate the deformation caused when moving die and the fixed die are certain pressure, Chinese patent discloses an injection molding machine with a basic C-shape frame, a fixed die is fixed on one leg of side injection molding machine, a closing device is fixed on the other side leg, said closing device push moving die approach or away from the fixed die through a hinge member, the hinge member is connected to the moving die through two supporting surfaces which are spaced from each other, and the hinge member makes two supporting surfaces respectively located above or below a horizontal center plane of fixed die. In injection molding process, a certain deformation of the moving die or the fixed die will be caused due to the injection molding pressure, said deformation will be passed to hinge member through the two supporting surfaces spaced from each other, part of the deformation is absorbed by the hinge member, in order to keep the moving die and the fixed die in parallel under closing pressure. In the case that the injection molding pressure is smaller, the above mentioned compensation device can be used to compensate the deformation of moving die and fixed die, which can decrease the deformation of die cavity of molding. However, when the injection is larger, pressure on the moving die and the fixed die will be passed to a frame which supports the moving die and the fixed die, since the lower portion of the frame is fixed, the left and right ends of the frame are stretched outward by the above mentioned injection molding pressure, the moving die track, located on the upper side of the frame of injection molding machine, may have a upward arching deformation caused, and a deformation which squeezes from both ends toward the middle is caused in lateral board located on the lower side of the frame of injection molding machine. This deformation increases the relative deformation between moving die and fixed die, thus seriously affects the shape of the injection molding products. However, influences caused by deformation of the body of frame will always be ignored by technical staff, therefore only designing a deformation compensation device on moving die or fixed die obviously could not meet the requirements of those products which have larger injection molding pressure and require higher on product quality.

In addition, frames in the prior art are of substantially C-shape or H-shape, a moving die driving device is fixed on a upwardly extending portion of each end of the frame, and the locking of moving die device is realized through a locking connection driving device and a connecting rob of the moving die, when casting after mold locking, injection pressure is put on the upward extending portion of both ends thereof through above mentioned driving device, because a larger pressure is put on the upward extending position of both ends, therefore reinforcement to both ends of frame is needed, this leads to a particularly bulky frame which is with a complex structure, inconvenient to maintenance and difficult to move; and the above mentioned connecting rob not only needs to make a telescopic movement, but also bears a larger locking force, which makes the connecting rob apt to be damaged; in addition, because the distance between the ends of the frame is certain, and pushing mechanism and locking mechanism with a complex structure is provided behind moving die, the extended application range of die casting machine is limited.

SUMMARY OF THE INVENTION

In view of the above-described problem, it is one objective of the invention to provide a die casting machine with L-shape frame which effective compensates the distortion of the frame itself, thereby improve the distortion of production and production efficiency.

Another objective of the invention is to provide a locking device of die casting machine, which is of a simple structure of die casting and a reliable locking mechanism.

To achieve the above objectives, in accordance with one embodiment of the invention, provided is a die casting machine with L-shape frame, comprising at least one L-shape frame, a fixed die plate, fixed on one end of an upward extending side of said frame, a moving die device, disposed on the other side of said frame and slidable relative to said frame, and comprising a moving die plate opposite to said fixed die plate, and being lockable to said frame by a mould clamping device; a notch, formed on a bottom of said frame, a first deformation compensation device, provided in said notch, and adapted for applying forces in opposite directions on both sides of said notch, while said moving die plate is being clamped with said fixed die plate.

In a class of this embodiment, said first deformation compensation device comprises a pair of guide blocks, provided in said notch and spaced from each other in a stress direction of said notch; an expansion device, provided between two said guide blocks and adapted for driving said guide blocks to push on both sides of said notch.

In a class of this embodiment, both said guide blocks have an interval in the form of a wedge cavity formed therebetween; said expansion device is an expansion wedge block matching with said wedge cavity, and said expansion wedge block is adapted for pushing said two guide blocks arranged facing each other to move oppositely.

In a class of this embodiment, said die casting machine comprises two said frames arranged in parallel and with the same size and shape; two said first deformation compensation devices of two said frames are provided facing with each other; two said expansion wedge blocks are provided facing with each other, and both sides of said two expansion wedge blocks facing each other form a wedge space; and In a class of this embodiment, a pushing wedge block is provided between two said expansion wedge blocks, said pushing wedge block matches with the wedge space between two expansion blocks, and said pushing wedge block is adapted for being driven by a pushing mechanism to push two said expansion block move oppositely.

In a class of this embodiment, said pushing mechanism is a quick cylinder, a supporting block is provided between a driving end of said pushing wedge block and said pushing mechanism, both ends of said supporting block are fixed on both insides of two said frame respectively; a through hole is provided on said supporting block for a driving end of said pushing mechanism to pass through.

In a class of this embodiment, said notch is provided at a position right under the clamping mould position of said moving die plate and said fixed die plate, said frame is provided with an elongated hole located on an upside of said notch and extending in the moving direction of said moving die device, the distance between an end of said elongated hole close to said moving die device and said notch is larger than the distance between the other end of said elongated hole close to said fixed die plate and said notch.

In a class of this embodiment, a stress changing notch is provided close to and under the end of the frame away from said fixed die plate, and upward extending from the bottom of said frame.

In a class of this embodiment, said die casting machine also comprises a second deformation compensation device, provided close to said moving die device and/or said fixed die plate, and said second deformation compensation device comprises, a first base plate, a second base plate, arranged parallel with said first base plate, said first base plate and said second base plate have a plurality of elastic components provided therebetween, said first base plate or said second base plate is in fixed connection with said moving die plate or said fixed die plate.

In a class of this embodiment, said elastic components are disc springs provided between said first base plate and said second base plate, said disc springs are sleeved on a screw bolt; said screw bolt is arranged extending through said first base plate and said second base plate, and said screw bolt is locked by a screw nut, in order to connect said disc springs between said first base plate and said second base plate in a pre-compressed manner.

In a class of this embodiment, said first base plate and said second base plate are rectangular plates with the same size, a plurality of said elastic components horizontally and vertically arranged between said first base plate and said second base plate in regular manner, and density of said elastic components at the middle position is lower than that of said elastic components at the perimeter of the plate.

In a class of this embodiment, a dust guard plate is provided between said first base plate and said second base plate.

In a class of this embodiment, said second deformation compensation device is mounted inside a sliding seat said second deformation compensation device is located on inner side of said sliding seat, said first base plate is in fixed connection with said moving die plate; and under the action of driving device, said sliding seat is operable for rendering said moving die plate to move towards or away from said fixed die plate.

In a class of this embodiment, said moving die device also comprises a rapid pressurization and pressure relief device for pressurizing and relieving the pressure on said elastic components.

In a class of this embodiment, said rapid pressurization and pressure relief device comprises a driving mechanism for driving the rotation of said screw bolt, an moving block and a driving block, provided between said moving die plate and an end part of said screw bolt and connected with each other; said moving block and said screw bolt are circumferentially fixed with each other in a position-limited manner or integrally formed; said driving block and said moving die plate are circumferentially fixed with each other in a position-limited manner or integrally formed; said moving block and said driving block have an protrusion and a groove arranged therebetween, which coordinate with each other; said driving mechanism is adapted for driving the rotation of said screw bolt, which further drives said moving block to slide relative to said driving block, in order to allow said protrusion to push said screw bolt to extrude said first base plate, when said protrusion slides out of said groove; and said protrusion is adapted for relieving the extrusion to said first base plate, when said protrusion slides into said grooves.

In a class of this embodiment, said driving mechanism comprises a gear, fixed on said screw bolt, a gear rack, coordinating with said gear and adapted for pushing said gear to rotate forward and backward; and said gear rack is connected with a driving device.

In a class of this embodiment, one end of said moving block is circumferentially fixed on one end part of said screw bolt in a position limited manner, the other end of said moving block have said groove formed thereon, a cross-section of said grooves is a trapezium, and said protrusions is a trapezium-shaped protrusion; the rotation of said screw bolt drives trapezium-shaped said grooves to slide along an inclined plane of trapezium-shaped said protrusion.

In a class of this embodiment, said frame has a track formed on a side thereof, on which said moving die device is mounted; said mould clamping device is in fixed connection with or integrally formed with said moving die device and operable for locking said moving die device on said track.

In a class of this embodiment, said mould clamping device comprise mould clamping cavities respectively located at both sides of said tracks and formed on said sliding seat; and each said mould clamping cavity has a locking wedge block and a pushing wedge block located at the inner side thereof; each said locking wedge block is provided close to said track, each said pushing wedge block is located between said locking wedge block and inner side of said mould clamping cavity; under the actuation of said mould clamping drive mechanism, each said pushing wedge block is operable for pushing said locking wedge blocks on both sides of said tracks to clamp said track.

In a class of this embodiment, said sliding seat has a supporting plate provided on a side thereof, which is away from said moving die plate; said supporting plate is located above said track; and said supporting plate and said sliding seat respectively have one said mould clamping device provided at the bottom thereof; two said mould clamping devices are adapted for being driven by one said mould clamping drive mechanism.

In a class of this embodiment, said mould clamping drive mechanism is an air cylinder or an oil cylinder, said air cylinder or said oil cylinder has two driving ends with opposite driving direction, said air cylinder or said oil cylinder is provided between said mould clamping device beneath said supporting plate and said mould clamping device beneath said sliding seat; two said driving ends are respectively connected with said pushing wedge blocks on two said mould clamping devices; when the driving ends of said air cylinder or said oil cylinder are retracted, said driving ends drive said pushing wedge block pushes said locking wedge block to realize mould clamping; when the driving end of said air cylinder or said oil cylinder is pushed out, locking of said moving die device is relieved.

In a class of this embodiment, the machine comprises two said supporting plates respectively provided on two said frames arranged facing with each other, adjacent two said supporting plates are connected through a junction plate as a whole.

In a class of this embodiment, said mould clamping device also comprises an unlock reset device for resetting said locking wedge block when unlocking.

In a class of this embodiment, said unlock reset device is a reset screw; a reset spring is sleeved on said reset screw; said reset screws on both sides of said frames extend through an external wall of said mould clamping cavity and the body of said pushing wedge block, one end of said reset spring abuts against a screw head of said reset screw, the other end of said reset spring abuts against an external wall of said mould clamping cavity; the body of said pushing wedge block has a through hole provided therein, which is for said reset screw to pass through; and the width of said though hole matches with the pushing stroke of said pushing wedge block; both sides of said pushing wedge block arranged between two said frame respectively have a die cavity formed thereon, screw head of said reset screw and said reset spring are both placed inside said die cavity, one end of said reset spring abuts against a screw head of said reset screw, the other end of said reset spring abuts against an wall of said die cavity close to the outside; and said die cavity has an elongated hole provided thereon, for a screw bolt of said reset screw to pass through, in order to be screwed into the body of said locking wedge block, and the screw bolt of said reset screw is slidable along the elongated hole.

In a class of this embodiment, a supporting block for position limitation is provided between said mould clamping device beneath said supporting plate and said mould clamping device beneath said sliding seat.

In a class of this embodiment, a cross-section of said track is a T-shape cross-section, said moving die device is operable for sliding along a horizontal upper surface of said track, said mould clamping device coordinates with two vertical sides of said track in a locking manner.

In a class of this embodiment, the horizontal upper surface of said track is connected with two vertical sides of said track respectively though an inclined plane to form a transition; said locking wedge block has a locking inclined plane provided on the side close to said inclined plane, which coordinates with said inclined plane in a clamping manner.

In a class of this embodiment, a linear guide plate is provided between the upper surface of said track and said mould clamping device, which is in fixed connection with said track.

In a class of this embodiment, said driving device is an air cylinder or an oil cylinder, the driving end of said air cylinder or said oil cylinder is connected with said sliding seat, a supporting seat of said air cylinder or said oil cylinder is mounted on the end of said frames away from said fixed die plate.

In a class of this embodiment, a junction plate or supplying materials is provided at the upward extending end part of said frames, said junction plate is connected with a material supply device.

In a class of this embodiment, two said frames, adjacent to each other, have a plurality of stop members are provided between, said stop members are adapted for preventing said frames from deforming or moving in the thickness direction.

Advantages of the Invention Comprise:

1. A notch is formed on a lower portion of the frame of die casting machine of the present invention, a first deformation compensation device is provided in said notch, and adapted for applying forces in opposite directions on both sides of said notch, while said moving die plate is being clamped with said fixed die plate. When the frame is distorted by injection pressure and deforms, the first deformation compensation device is controlled to apply forces on both sides of the notch, in order to compensate the squeeze to the central section on the bottom of frame because of the injection pressure, which weakens the elastic distortion of the track on the frame, and eliminates the influence on die casting or injection molding products due to deformation.

2. The frame of present invention adopts a L-shape structure, which comprises at least one L-shape frame, said L-shape of the present invention refers to a frame, the overall shape of which approximates the shape of letter "L", that is, the frame has a horizontal end surface extending in the horizontal direction, a vertical end surface is upward extending on the end of the horizontal end surface, a fixed die plate is fixed on one end of the upward extending vertical end surface side of said frame, a moving die device is disposed on the other side of said frame and slidable relative to said frame. This kind of frame is convenient to be manufactured, assembled, moved and maintained; meanwhile as the moving die is disposed on the horizontal disposed track of L-shape frame, and only one end of said track has upward extending component for fixing the fixed die plate, it is convenient to extend or shorten the distance of horizontal track of this kind of frame according to the actual needs, thereby the expansibility and the scope of application of machine is improved.

3. In the first deformation compensation device of the present invention, both guide blocks have an interval in the form of a wedge cavity formed therebetween; the expansion device is an expansion wedge block matching with said wedge cavity, and said expansion wedge block is adapted for pushing said two guide blocks arranged facing each other to move oppositely. The first deformation compensation device of the present invention adopts the structure of wedge blocks coordinating with each other in swelling manner, so that this kind of structure always ensure an driving of two surfaces in a coordinating manner, during the process of deformation compensation, thereby stabilizing the compensation action and avoiding the adverse effects of vibration, etc.

4. A stress changing notch is provided close to and under the end of the frame of the present invention away from said fixed die plate and upward extending from the bottom of said frame. The direction of injection pressure, which is put in the same direction as the force acted on the end of the frame opposite to the fixed die, can effectively changed by providing the stress changing notch, and the stress line of the pressure in the frame can be moved from the end of frame to the inner side of the notch, which shortens the distance between the force supporting points, further reduces the deformation of the track of frame stressed.

5. The moving die device of the present invention also comprises a second deformation compensation device, said second deformation compensation device comprises, a first base plate, a second base plate arranged parallel with said first base plate; and said first base plate and said second base plate have a plurality of elastic components provided therebetween, said first base plate or said second base plate is in fixed connection with said moving die plate or said fixed die plate. In addition to the first deformation compensation device provided under the frame of the present invention, a second deformation compensation device is also provided on the moving die plate, and said moving die plate is provided close to the second deformation compensation device; in this way, thus, the second deformation compensation device may firstly compensate deformation of moving die plate and fixed die plate caused by injection pressure, and the deformation of the frame may be compensated by the first deformation compensation device. Therefore, it may help to significantly reduce the influence on the products due to deformation by using two deformation compensation devices to compensate the deformation in the process of die casting or injection molding, so as to significantly improve the percent of pass and production efficiency of products.

6. The screw bolt of the present invention is arranged extending through said first base plate and said second base plate, and said screw bolt is locked by a screw nut, in order to connect said disc springs between said first base plate and said second base plate in a pre-compressed manner. The elastic component between two base plates is in a pre-compressed state when it is mounted, the level of force of pre-compression is determined by the specific injection pressure, thereby increasing the initial pressure variation value when elastic component compensates the distortion, and the compression stroke that the moving die plate compress the elastic under injection pressure is decreased, and then the sealing effect when mold closing is enhanced.

7. The moving die device of the present invention also comprises a rapid pressurization and pressure relief device for pressurizing and relieving the pressure on said elastic components. On basis of the pre-compression of elastic component, said device may compress the elastic components again, which further improves the pressure resistance of the elastic components and resist the injection pressure, meanwhile said device may relieves the pressure after injecting the materials, and the elastic components is returned to the preliminary pre-compressed state, and this avoid the elastic components of being always in a high pressure state, in which the elastic components are apt to be damaged.

8. The frame of the present invention has a track formed on a side thereof, on which the moving die device is mounted; said mould clamping device is in fixed connection with or integrally formed with said moving die device and operable for locking said moving die device on said track. The mould clamping device of the present invention is in fixed connection with or integrally formed with said moving die device, which shortens the distance from locking point to die cavity of production and the distance between the injection pressure to supporting point, and may decrease the deformation of the frame itself.

9. The mould clamping device of the present invention comprises a mould clamping cavity and a pushing wedge block located at the inner side of the mould clamping cavity. Under the propelling of pushing wedge block, the locking wedge blocks cling and lock on both sides of said tracks for mould clamping, so as to apply a larger and even locking force on the track without causing any deformation; meanwhile since the mould clamping devices of the present invention are respectively locked at both sides of said tracks without fixing locking mechanism at one end of the frame, the overall length of the machine is shortened, which significantly reduces the deformation of supporting leg and frame. Besides, the moving die plate does not have a large air cylinder or an oil cylinder disposed at the rear thereof for driving out the locking mechanism, and it is easy for some die casting machine or injecting molding machine to have an injection system to dispose on the side of moving die, so as to avoid of using a rotational mold.

10. A supporting plate is provided at the back of sliding seat of the present invention, and mould clamping device is provide under the supporting plate, so that two said mould clamping devices share the same driving device. Due to the injection pressure, the sliding seat may rotate counterclockwise around the mould clamping point, although the second deformation compensation device compensates the deformation; however, once the injection pressure is excessive, tightness of clamping sealing surface will still be seriously affected, the sliding seat will be effectively supported, the counterclockwise rotation of which will be obstructed by providing a supporting plate at the back of sliding seat, which ensures the tightness of clamping sealing surface, besides, a mould clamping device is provided under the supporting plate, the mould clamping device shares a mould clamping drive mechanism with the mould clamping device provided under the sliding seat, which not only improve the stability of clamping, but also streamlined structure and save energy.

BRIEF DESCRIPTION OF THE DRAWINGS

Detailed description will be given below in conjunction with accompanying drawings.

Figure 1:
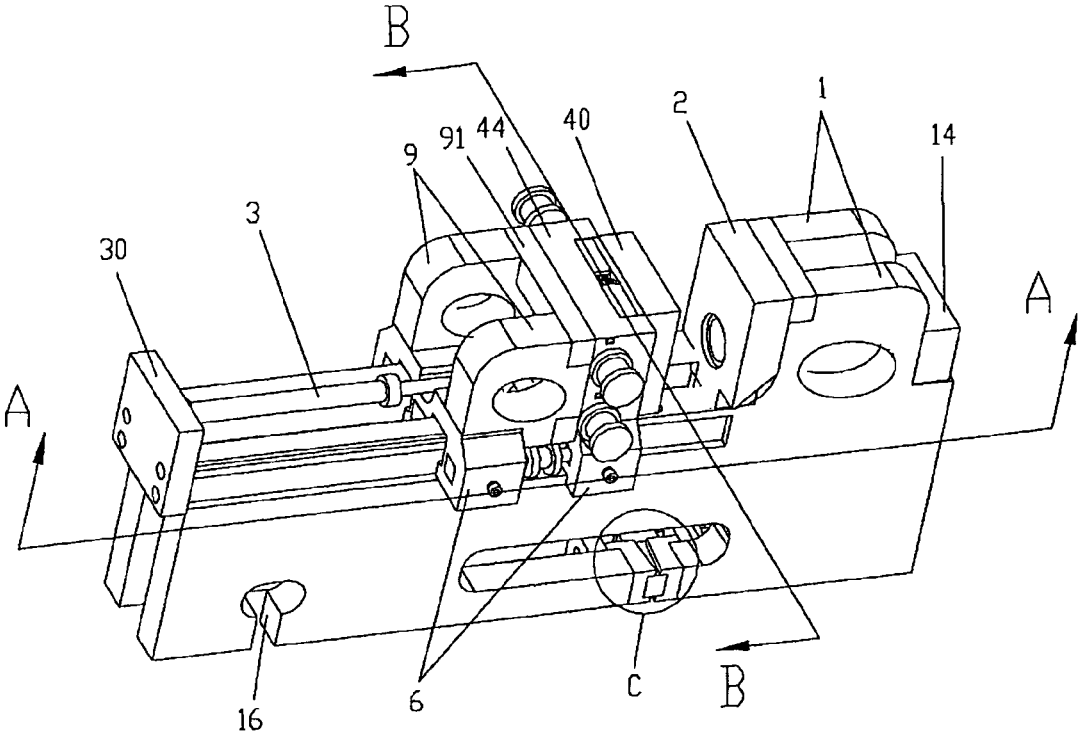
FIG. 1 is a schematic view of the overall structure of one embodiment of the present invention.

In the drawings, the following reference numbers are used:

1—frame; 11—track; 12—notch; 13—linear guide plate; 14—junction plate or supplying materials, 15—inclined plane; 16—stress changing notch; 17—junction plate; 2—fixed die plate; 3, 7—driving device; 30—supporting seat; 4—second deformation compensation device; 40—moving die plate; 41—first base plate; 42—second base plate; 43—elastic component; 431—screw bolt;

432—screw nut; 433—baffle ring; 434—gear; 435—gear rack; 436—groove; 437—moving block; 438—driving block; 439—protrusion; 44—sliding seat; 5—first deformation compensation device; 51—guide block; 510—guide groove; 52—Expansion wedge block; 53, 62—pushing wedge block; 54—supporting block; 55—pushing mechanism; 56—stop member; 6—mould clamping device; 60—mould clamping drive mechanism; 61—mould clamping cavity; 63—locking wedge block; 64—reset screw; 65—reset spring; 66—supporting block; 8—dust guard plate; 9—supporting plate; 91—junction plate;

DETAILED DESCRIPTION OF THE EMBODIMENTS

Embodiment 1

Figure 2:
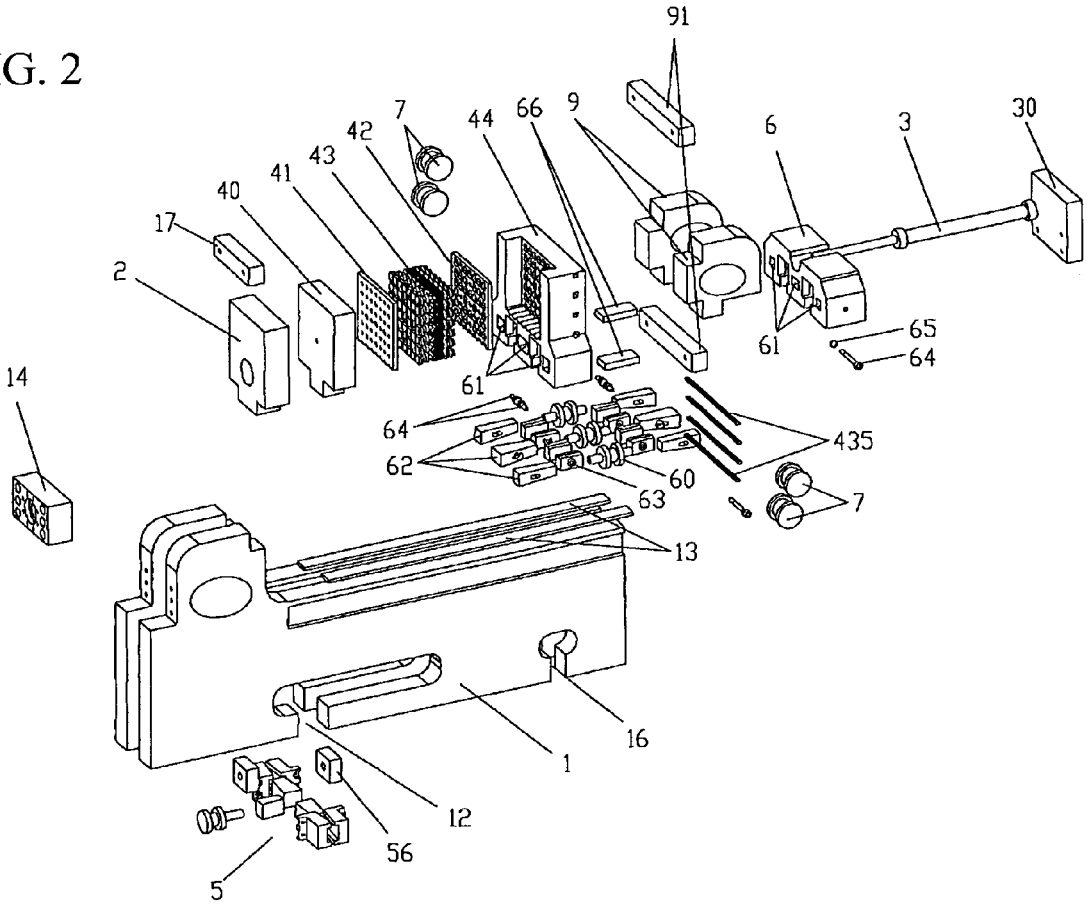
FIG. 2 is an explosive view of one embodiment of the present invention.

As shown in FIG. 1-2, the present invention disclose a die casting machine with L-shape frame, comprising two frames 1 arranged in parallel and with the same size and shape; a fixed die plate (2), fixed on one end of an upward extending side of said frame (1); a moving die device, disposed on the other side of said frame and slidable relative to said frame and comprising a moving die plate (40) opposite to said fixed die plate (2), and being lockable to said frame (1) by a mould clamping device (6); a notch (12), formed on a bottom of said frame (1); a first deformation compensation device (5), provided in said notch (12) and adapted for applying forces in opposite directions on both sides of said notch (12) while said moving die plate (40) is being clamped with said fixed die plate (2).

Figure 3:
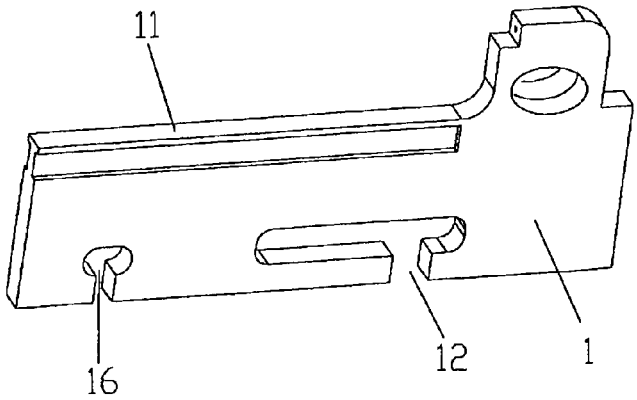
FIG. 3 is a structural schematic view of frame of one embodiment of the present invention.
Figure 4:
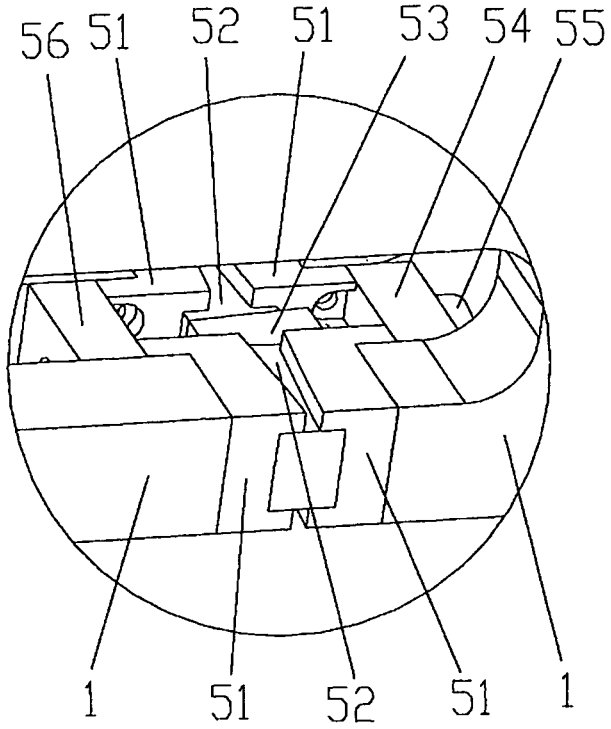
FIG. 4 is an enlarged view of the position C of FIG. 1 one embodiment of the invention.
Figure 5:
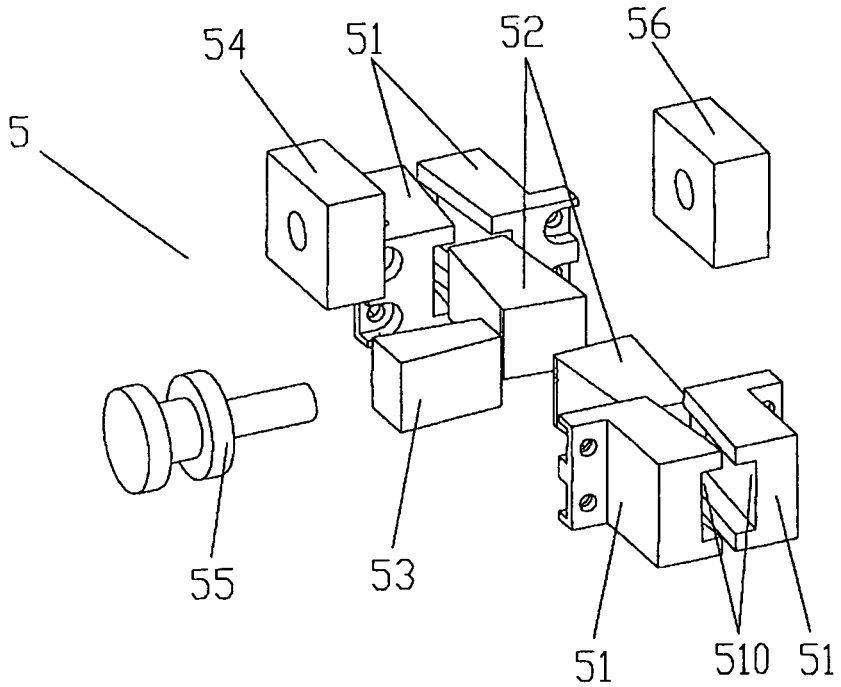
FIG. 5 is a structural explosive view of first deformation compensation device of one embodiment of the present invention.
Figure 6:
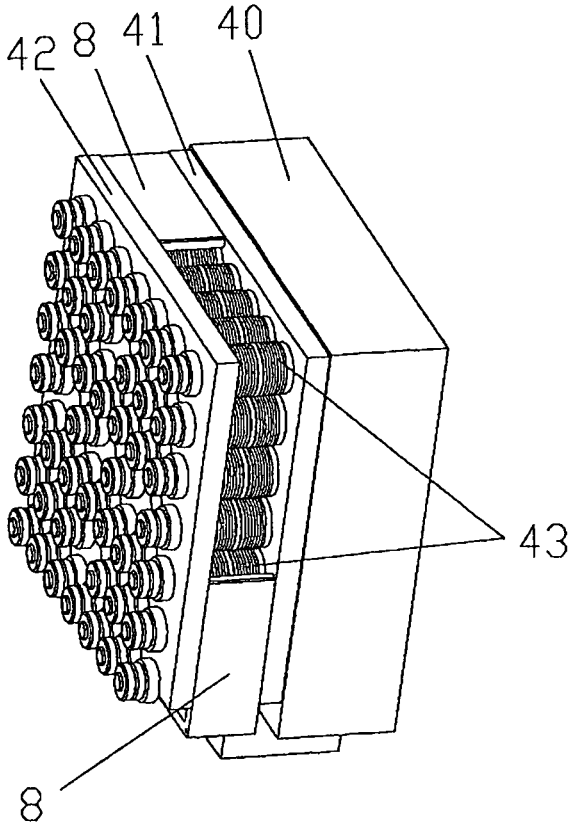
FIG. 6 is a structural schematic view of one embodiment of the present invention with the second deformation compensation device connected to moving die plate.

As a preferred structure of first deformation compensation device of the present invention, as shown in FIG. 3-5, in the present embodiment, said first deformation compensation device comprises a pair of guide blocks (51), provided in said notch (12) and spaced from each other in a stress direction of said notch (12); an expansion device, provided between two said guide blocks (51) and adapted for driving said guide blocks (51) to push on both sides of said notch (12), i.e, the movement is in the direction opposite to the stress direction of the lower portion of the frame.

In the present embodiment, both said guide blocks (51) have an interval in the form of a wedge cavity formed therebetween; said expansion device is an expansion wedge block (52) matching with said wedge cavity, and said expansion wedge block (52) is adapted for pushing said two guide blocks (51) arranged facing each other to move oppositely. In order to make sure the expansion movement of said expansion wedge block 52 is guided by said guide blocks 51 accurately and smoothly, said guide blocks 51, which are provided facing with each other respectively have a guide groove 510 thereon, a space between said two guide grooves 510 is of the size and shape matching with that of said expansion wedge block 52, said expansion wedge block 52 is operable to make an expansion along said guide groove 510.

Preferably, in the present embodiment, two said first deformation compensation devices (5) of two said frames (1) are provided facing with each other; wherein, two said expansion wedge blocks (52) are provided facing with each other, and both sides of said two expansion wedge blocks (52) facing each other form a wedge space; and a pushing wedge block (53) is provided between two said expansion wedge blocks (52), said pushing wedge block (53) matches with the wedge space between two expansion blocks (52), and said pushing wedge block (53) is adapted for being driven by a pushing mechanism (55) to push two said expansion block (52) move oppositely.

The structure of said pushing mechanism is not unique, in the present embodiment, said pushing mechanism (55) is a quick cylinder, a supporting block (53) is provided between a driving end of said pushing wedge block (53) and said pushing mechanism (55), both ends of said supporting block (54) are fixed on both insides of two said frame (1) respectively; a through hole is provided on said supporting block (54) for a driving end of said pushing mechanism (6) to pass through.

As shown in FIG. 3, in the present embodiment, said notch (12) is provided at a position right under the clamping mould position of said moving die plate (40) and said fixed die plate (2), said frame (1) is provided with an elongated hole located on an upside of said notch (12) and extending in the moving direction of said moving die device, the distance between the end of said elongated hole close to said moving die device and said notch (12) is larger than the distance between the other end of said elongated hole close to said fixed die plate (2) and said notch (12), said elongated hole is provided in favor of assembling and maintenance of equipments.

In the present embodiment, a stress changing notch (16) is provided close to and under the end of the frame away from said fixed die plate (2), and extending upward from the bottom of said frame (1), the width of the lower end of said stress changing notch is less than that of the upper end, said stress changing notch extending upward to the position at one third of the height of said frame 1. The stress line of injection pressure applied to the end of the frame away from said fixed die plate can be moved inwards to the right side of said stress changing notch 16 by providing said stress changing notch 16, which shortens the distance between supporting point and stress point and decreases the elastic deformation of the upper part of the frame.

As another alternative embodiment, the above mentioned first deformation compensation device 5 can be bidirectional air cylinder or oil cylinder applied to said notch 12, said device is controlled to apply force on both sides of said notch 12, in order to compensate the deformation.

Embodiment 2

Base on the embodiment 1, as shown in FIG. 6-9, said die casting machine also comprises a second deformation compensation device, provided close to said moving die device and/or said fixed die plate (2), and said second deformation compensation device comprises a first base plate (41), a second base plate (42) arranged parallel with said first base plate (41); said first base plate (41) and said second base plate (42) have a plurality of elastic components (43) provided therebetween, said first base plate (41) or said second base plate (42) is in fixed connection with said moving die plate (40) or said fixed die plate (2). In the present embodiment, said first base plate is in fixed connection with said moving die plate 40.

In the present embodiment, several elastic components 43 are arranged regularly, specially, since said first base plate 41 and said second base plate 41 are regular rectangle plates, said elastic components 43 are arranged horizontally and vertically in a certain order. said elastic components (43) are disc springs provided between said first base plate (41) and said second base plate (42), said disc springs are sleeved on a screw bolt (431); said screw bolt (431) is arranged extending through said first base plate (41) and said second base plate (42), and said screw bolt is locked by a screw nut, in order to connect said disc springs between said first base plate (41) and said second base plate (42) in a pre-compressed manner.

The level of force of the pre-compression is determined by the specific injection pressure, thereby increasing the initial pressure variation value when elastic component compensates the distortion, and the compression stroke that the moving die plate compress the elastic under injection pressure is decreased, and then the sealing effect is enhanced when mold closing. In order to avoid of abrasion between screw bolt 431 and each of screw nut 432 and said first base plate 41, when screw bolt 431 and said second base plate 42 pre-compress on said disc springs, said screw bolt 431 and said first base plate 41, and said screw nut 432 and said second base plate 42 respectively have a baffle ring 433 provided therebetween.

In the present embodiment, a dust guard plate (8) is provided between said first base plate (41) and said second base plate (42). Said dust guard plate 8 allows a certain distance between said first base plate 41 and said second base plate 42, during the process for adjusting the elasticity of the elastic components 43. In the present embodiment, aid second deformation compensation device (4) is mounted inside a sliding seat (44), said second deformation compensation device (4) is located on inner side of said sliding seat (44), and said first base plate (41) is in fixed connection with said moving die plate (40); and under the action of driving device (3), said sliding seat (44) is operable for rendering said moving die plate (40) to move towards or away from said fixed die plate (2).

Said driving device 3 in the present embodiment is an air cylinder or an oil cylinder, or a driving mechanism in other forms, the driving end of said air cylinder or said oil cylinder is connected with said sliding seat 44, the supporting seat 30 of said air cylinder or said oil cylinder is mounted on the opposite side of said fixed die plate 2 of said frame 1. Said driving device 3 in the present embodiment is only used for pushing said moving die device to the matching position with said fixed die plate, or pulling said moving die device back to original position, said moving die device is locked by locking device 6 under said moving die device, which reduces the amount of mechanical components at the opposite side of said moving die device for the convenience of the arrangement of other expansion devices, and this widens the scope of the present invention and is also in favor of assembling or maintenance of the device.

In the present embodiment, said second deformation compensation device is provided on said moving die device, however, in other embodiments, said second deformation compensation device can be provided on fixed die plate side, or provided respectively on moving die plate and fixed die plate.

Embodiment 3

Figure 9:
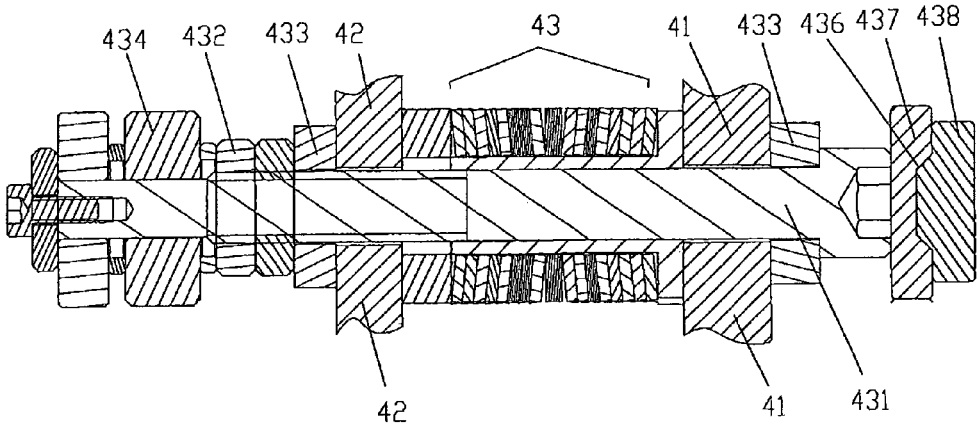
FIG. 9 is a vertical section view of the second deformation compensation device and the rapid pressurization and pressure relief device of one embodiment of the present invention.
Figure 10:
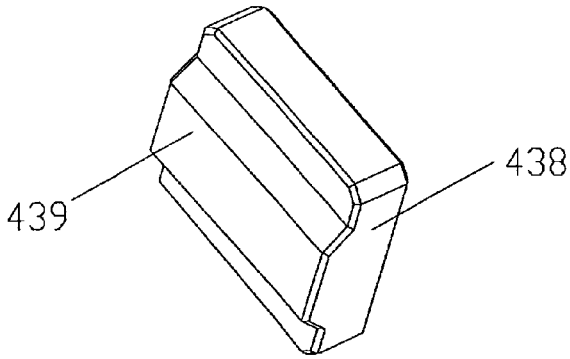
FIG. 10 is a structural schematic view of driving block of one embodiment of the present invention.

Base on the above mentioned embodiment 2, as shown in FIG. 9-10, said moving die device also comprises a rapid pressurization and pressure relief device for pressurizing and relieving the pressure on said elastic components (43). Said rapid pressurization and pressure relief device comprises a driving mechanism for driving the rotation of said screw bolt (431), an moving block (437) and a driving block (438), both of which are provided between said moving die plate (40) and an end part of said screw bolt (431) and connected with each other; said moving block (437) and said screw bolt (431) are circumferentially fixed with each other in a position-limited manner at the bolt head; said driving block (438) and said moving die plate (40) are circumferentially fixed with each other in a position-limited manner in the groove of said moving die plate 40. In the present embodiment, said driving block 438 is a rectangle block, said moving block 437 is a circularity block, and the side-length of said driving block 438 is smaller than the diameter of said moving block 437, the length of diagonal of said driving block 438 is larger than the diameter of said moving block 437; a blind hole, with its position corresponding to said elastic component 43, is provided on the surface of said moving die plate 40 which coordinates with said first base plate 41, the shape of said blind hole is the same as the shape of horizontal projections of said driving block 438 and said moving block 437, i.e, said blind hole not only limits the axial rotation of said driving block 438, but also allows the cooperation between said driving block 438 and said moving block 437 in said blind hole, in addition, it is able to rotate with said screw bolt 431 forward and backward. The cross section of groove 436 of the present embodiment is a trapezium, and the protrusion (439) is a trapezium-shaped protrusion; the rotation of said screw bolt (431) drives the trapezium-shaped protrusion to move along an inclined plane of the trapezium-shaped groove (436) to slide along protrusion (439), in order to allow said protrusion (439) to push said screw bolt (431) to extrude said moving die plate 40, when said protrusion (439) slides out of said groove (436); and said protrusion (439) is adapted for relieving the extrusion to said moving die plate 40, when said protrusion (439) slides into said grooves (436).

Figure 7:
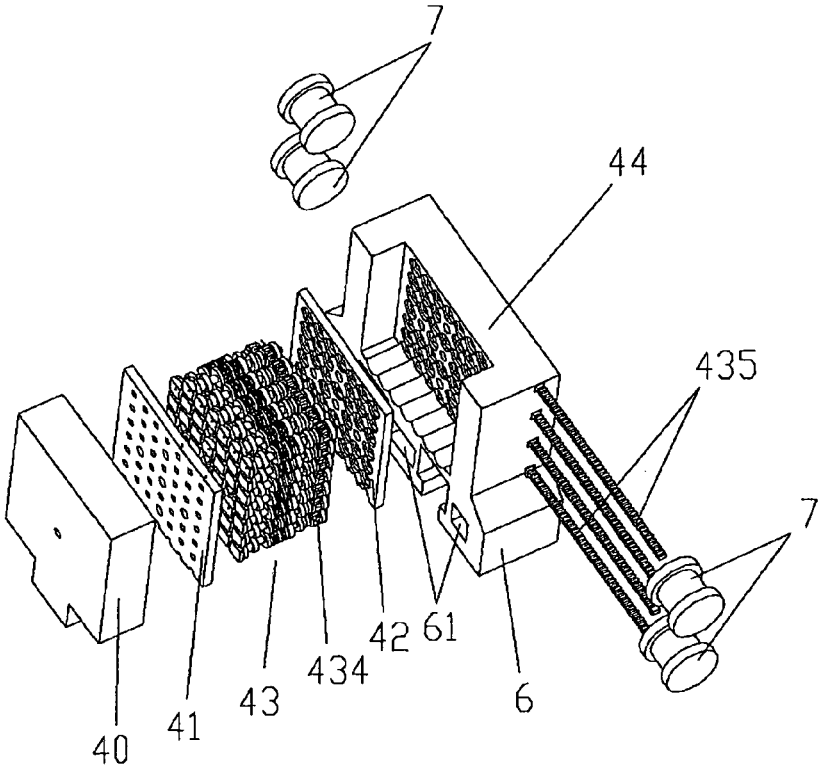
FIG. 7 is a structural explosive view of the moving die device of one embodiment of the present invention.
Figure 8:
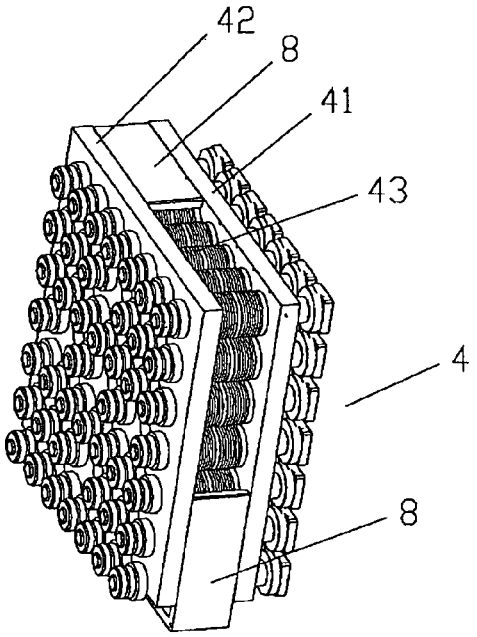
FIG. 8 is a structural schematic view of the second deformation compensation device of one embodiment of the present invention.
Figure 13:
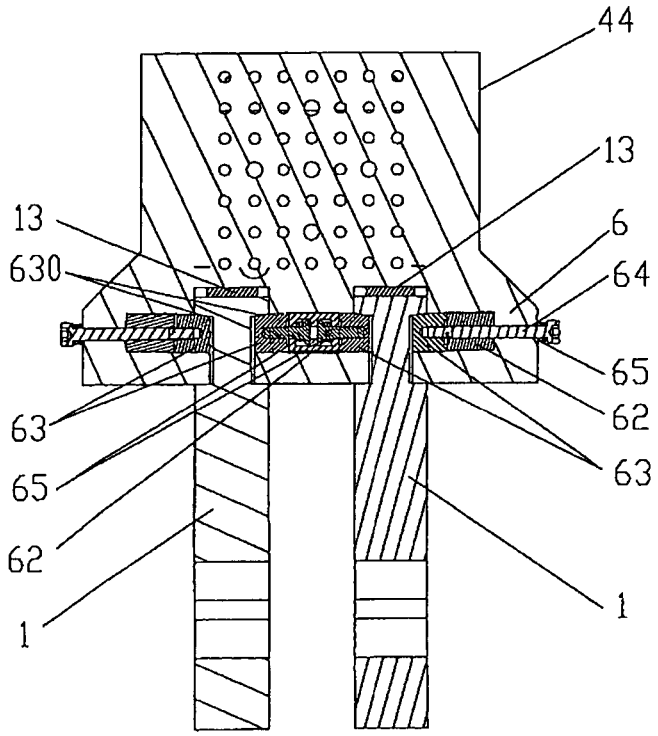
FIG. 13 is a sectional view along line B-B of FIG. 1.
Figure 14:
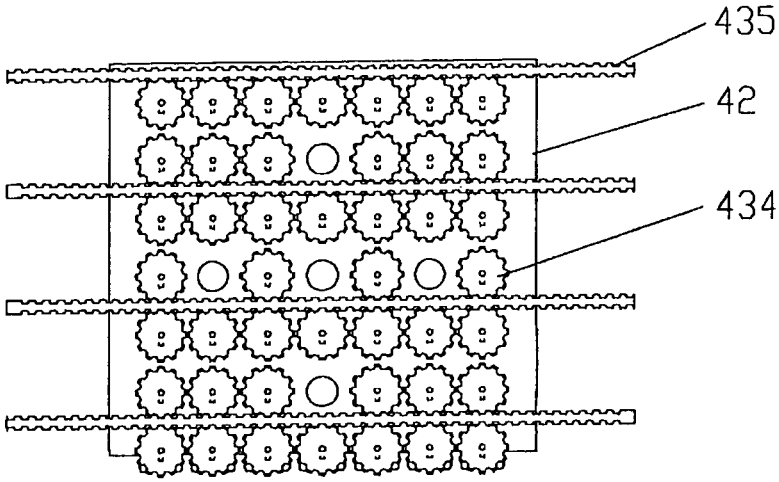
FIG. 14 is a structural schematic view of matching position of gear and gear rack.
Figure 15:
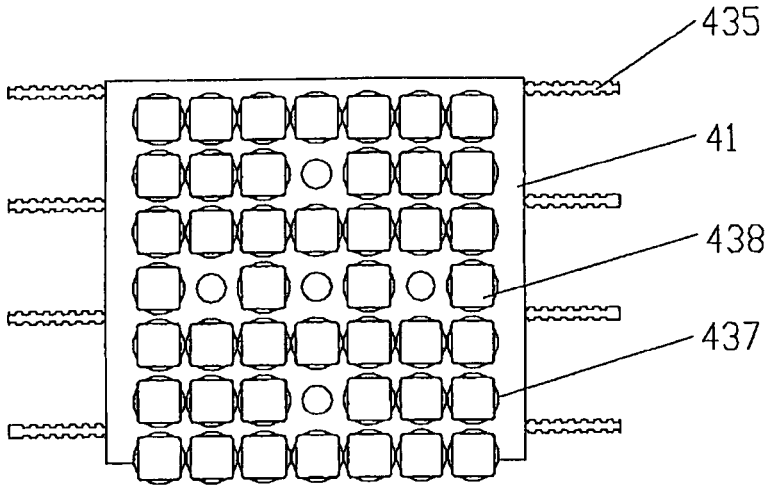
FIG. 15 is a right side view of FIG. 8.

As shown in FIG. 7, FIG. 13-14, the driving mechanism in the present embodiment which drives said screw bolt 431 to rotate comprises a gear (434), fixed on said screw bolt (431), a gear rack (435), coordinating with said gear (434) and adapted for pushing said gear (434) to rotate forward and backward; and said gear rack (435) is connected with a driving device (7), said driving device 7 is a driving air cylinder or a driving oil cylinder.

Embodiment 4

Base on the above mentioned embodiment 1 or 2 or 3, as shown in FIG. 1-3, said frame 1 of the present embodiment has a track (11) formed on a side thereof, on which said moving die device is mounted; said mould clamping device (6) is in fixed connection with or integrally formed with said moving die device (4), and operable for locking said moving die device (4) on said track (11).

As shown in FIG. 2, in the present embodiment, said mould clamping device (6) comprise mould clamping cavities (61) respectively located at both sides of said tracks and formed on said sliding seat (44); and each mould clamping cavity (61) has a locking wedge block (63) and a pushing wedge block (62) located at the inner side thereof; each locking wedge block (63) is provided close to said track (11), each pushing wedge block (62) is located between said locking wedge block (63) and inner side of said mould clamping cavity (61); under the actuation of said mould clamping drive mechanism (60), each pushing wedge block (62) is operable for pushing said locking wedge blocks (63) on both sides of said tracks (11) to clamp said track (11).

As shown in FIG. 1-2, said sliding seat 44 in above mentioned embodiment has a supporting plate (9) provided on a side thereof, which is away from said moving die plate (40); said supporting plate (9) is located above said track (11); and said supporting plate (9) and said sliding seat (44) respectively have one said mould clamping device (6) provided at the bottom thereof; two said mould clamping devices (6) are adapted for being driven by one said mould clamping drive mechanism 60.

Said mould clamping drive mechanism 60 in above mentioned embodiment is an air cylinder or an oil cylinder, said air cylinder or said oil cylinder has two driving ends with opposite driving directions, said air cylinder or said oil cylinder is provided between said mould clamping device (6) beneath said supporting plate (9) and said mould clamping device (6) beneath said sliding seat (44); two said driving ends are respectively connected with said pushing wedge blocks (62) on two said mould clamping devices (6); when the driving ends of said air cylinder or said oil cylinder are retracted, said driving ends drive said pushing wedge block (62) pushes said locking wedge block (63) to realize mould clamping; when the driving end of said air cylinder or said oil cylinder is pushed out, locking of said moving die device is relieved.

In the present embodiment, two supporting plates (9) respectively are provided on two frames (1) arranged facing with each other, and said supporting plates (9), adjacent to each other are connected through a junction plate (91) as a whole.

Figure 11:
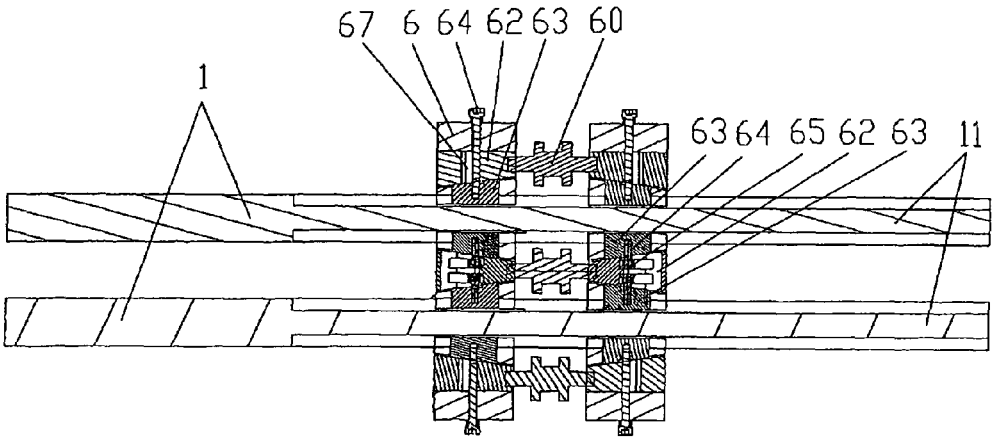
FIG. 11 is a sectional view along line A-A of FIG. 1 with the moving die device unlocked.
Figure 12:
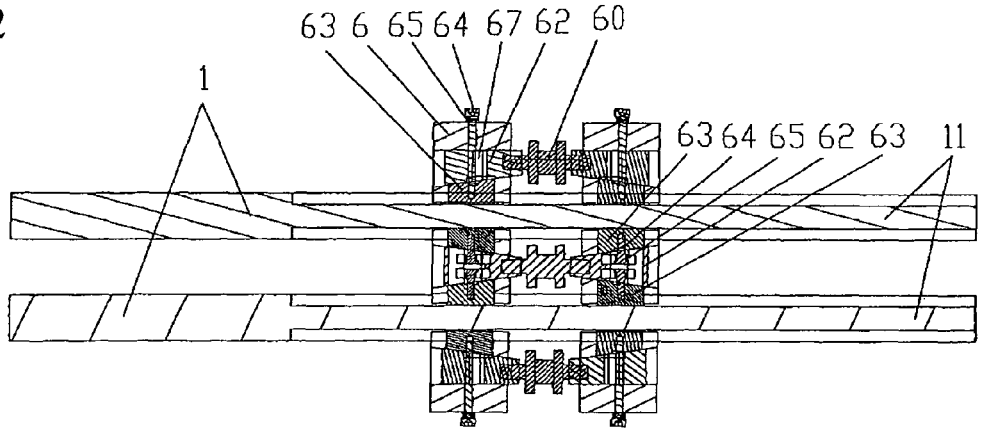
FIG. 12 is a sectional view along line A-A of FIG. 1 with the moving die device locked.

As shown in FIG. 11-13, said mould clamping device (6) also comprises an unlock reset device for resetting said locking wedge block (63) when unlocking. said unlock reset device is a reset screw (64) or other components such as screw bolt; a reset spring is sleeved on said reset screw (64); said reset screws (64) on both sides of said frames (1) extend through an external wall of said mould clamping cavity (61) and the body of said pushing wedge block (62); one end of said reset spring (65) abuts against a screw head of said reset screw (64), the other end of said reset spring (65) abuts against an external wall of said mould clamping cavity (61); the body of said pushing wedge block (62) has a through hole provided therein, which is for said reset screw (64) to pass through; and the width of said though hole matches with the pushing stroke of said pushing wedge block (62); both sides of said pushing wedge block (62) arranged between two said frame (1) respectively have a die cavity formed thereon, screw head of said reset screw (64) and said reset spring (65) are both placed inside said die cavity, one end of said reset spring (65) abuts against a screw head of said reset screw (64), the other end of said reset spring (65) abuts against an wall of said die cavity close to the outside; and said die cavity has an elongated hole provided thereon, for a screw bolt of said reset screw (64) to pass through, in order to be screwed into the body of said locking wedge block (63), and the screw bolt of said reset screw (64) is slidable along the elongated hole. A larger notch in the shape of circle or others for allowing said screw head to pass into the inner side of said die cavity is provided on one end of said elongated hole, said end is located at the position beyond the said locking stroke; when said pushing wedge block 62 between said two frames 1 pushes said locking wedge block 63 to unlock the moving die plate, said reset spring 65 is compressed and reserves energy; on the contrary, when said pushing wedge block 62 releases the locking of said locking wedge block 63, said reset spring 65 releases energy, and pulls said locking wedge block 63 away from the track 11 to complete the reset action.

In the above mentioned embodiment, a supporting block (66) for position limitation is provided between said mould clamping device (6) beneath said supporting plate (9) and said mould clamping device (6) beneath said sliding seat (44). Excessive closer of two said mould clamping devices 6 connected to two driving end of said mould clamping drive mechanism 60 is prevented by providing said supporting block 66 for position limitation, said excessive closer leads to excessive lock of locking mould even damage components such as wedge block inside mould clamping devices 6.

Figure 16:
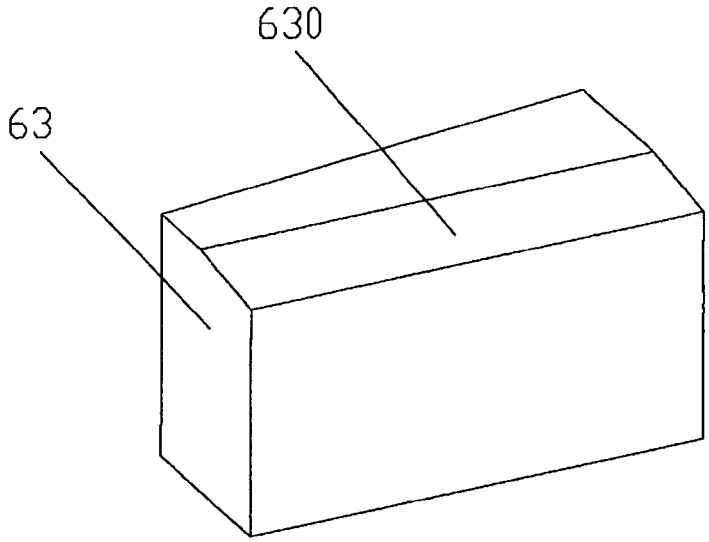
FIG. 16 is a structural schematic view of locking wedge block of the present invention.
Figure 17:
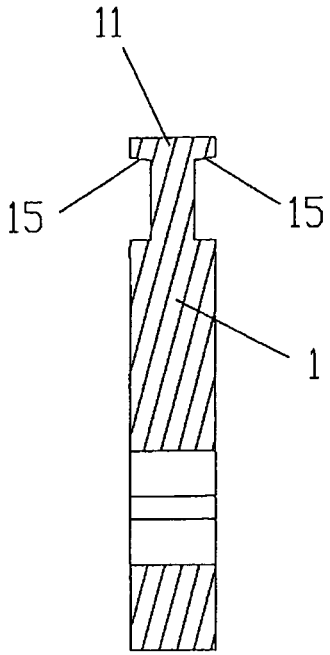
FIG. 17 is a sectional view along line B-B of the frame of the present invention.

As shown in FIGS. 13, 16 and 17, a cross-section of said track (11) is a T-shape cross-section, said moving die device is operable for sliding along an horizontal upper surface of said track (11), said mould clamping device (6) coordinates with two vertical sides of said track (11) in a locking manner; the horizontal upper surface of said track (11) of the present embodiment is connected with two vertical sides of said track (11) respectively though an inclined plane (15) to form a transition; said locking wedge block 63 has a locking inclined plane (630) provided on the side close to said inclined plane (15), which coordinates with said inclined plane (15) in a clamping manner. By providing said locking inclined plane 630 matching with said inclined plane 15, the vertical side of said T-shape track is locked by said locking wedge block 63, meanwhile under the coordination between said inclined plane 15 and said locking inclined plane 630, said mould clamping device 6 will be applied a downward stretching force that allows the mould clamping device to tightly abut against the upper surface of said track 11, in order to make the locking more firmly.

In the present embodiment, a linear guide plate (13) is provided between the upper surface of said track (11) and said mould clamping device (6), which is in fixed connection with said track (11). Said mould clamping device 6 is slidale along said linear guide plate 13, which not only facilitates relative sliding, but also avoid of excessive abrasion of said tracks 11 caused by sliding for long time, and this makes the machine easy to maintain In above mentioned embodiment, a junction plate or supplying materials (14) is provided at the upward extending end part of said frames (1), said junction plate or supplying materials (14) is connected with a material supply device, said junction plate or supplying materials 14 is adapted for connecting the equipment for injecting materials, meanwhile two frames 1 are connected as a whole by said junction plate. A junction plate 17 for connecting two frames 1 is provide on one end of an upward extending side of said frame opposite to the end that are integrally formed with said junction plate or supplying materials 14.

In above mentioned embodiment, two said frames 1, adjacent to each other, have a plurality of stop members (56) are provided between, said stop members (56) are adapted for preventing said frames from deforming or moving in the thickness direction. The width of said stop members 56 matches with the space between adjacent two said frames 1, said stop members 56 can be fixed by a screw or by other manners such as welding and so on.

The above mentioned embodiments only describe the embodiments with two frames 1 in detail, however, it is clear to skilled person in the art, said frame 1 is not only provided with one, but also provided with more than three, which is according to the technical requirements of injection molding or die casting products. It is apparent that the above embodiments are only detail explanations for the preferred embodiments, instead of limiting the implementing ways, to skilled person in the art, other modifications or alterations in various forms can also be made based on the above description.

What is claimed is:

1. A die casting machine with L-shape frame, comprising at least one L-shape frame, a fixed die plate, fixed on one end of an upward extending side of said frame, a moving die device, disposed on the other side of said frame and slidable relative to said frame, and comprising a moving die plate opposite to said fixed die plate, and being lockable to said frame by a mould clamping device;

a notch, formed on a bottom of said frame, a first deformation compensation device, provided in said notch and adapted for applying forces in opposite directions on both sides of said notch, while said moving die plate is being clamped with said fixed die plate.

2. The die casting machine of claim 1, wherein, said first deformation compensation device comprises a pair of guide blocks, provided in said notch and spaced from each other in a stress direction of said notch;

an expansion device, provided between two said guide blocks and adapted for driving said guide blocks to push on both sides of said notch.

3. The die casting machine of claim 2, wherein, both said guide blocks have an interval in the form of a wedge cavity formed therebetween;

said expansion device is an expansion wedge block matching with said wedge cavity, and said expansion wedge block is adapted for pushing said two guide blocks arranged facing each other to move oppositely.

4. The die casting machine of claim 3, wherein, said die casting machine comprises two said frames arranged in parallel and with the same size and shape; two said first deformation compensation devices of two said frames are provided facing with each other; two said expansion wedge blocks are provided facing with each other, and both sides of said two expansion wedge blocks facing each other form a wedge space; and a pushing wedge block is provided between two said expansion wedge blocks, said pushing wedge block matches with the wedge space between two expansion blocks, and said pushing wedge block is adapted for being driven by a pushing mechanism to push two said expansion block move oppositely.

5. The die casting machine of claim 4, wherein, said pushing mechanism is a quick cylinder, a supporting block is provided between a driving end of said pushing wedge block and said pushing mechanism, both ends of said supporting block are fixed on both insides of two said frame respectively;

a through hole is provided on said supporting block for a driving end of said pushing mechanism to pass through.

6. The die casting machine of claim 1, wherein, said notch is provided at a position right under the clamping mould position of said moving die plate and said fixed die plate, said frame is provided with an elongated hole located on an upside of said notch and extending in the moving direction of said moving die device, the distance between an end of said elongated hole close to said moving die device and said notch is larger than the distance between the other end of said elongated hole close to said fixed die plate and said notch.

7. The die casting machine of claim 1, wherein, further comprising a stress changing notch, provided close to and under the end of the frame away from said fixed die plate, and upward extending from the bottom of said frame.

8. The die casting machine of claim 1, wherein, said die casting machine also comprises a second deformation compensation device, provided close to said moving die device and/or said fixed die plate, and said second deformation compensation device comprises, a first base plate, a second base plate, arranged parallel with said first base plate, said first base plate and said second base plate have a plurality of elastic components provided therebetween, said first base plate or said second base plate is in fixed connection with said moving die plate or said fixed die plate.

9. The die casting machine of claim 8, wherein, said elastic components are disc springs provided between said first base plate and said second base plate, said disc springs are sleeved on a screw bolt;

said screw bolt is arranged extending through said first base plate and said second base plate, and said screw bolt is locked by a screw nut, in order to connect said disc springs between said first base plate said second base plate in a pre-compressed manner.

10. The die casting machine of claim 8, wherein, said first base plate and said second base plate are rectangular plates with the same size, a plurality of said elastic components horizontally and vertically arranged between said first base plate and said second base plate in regular manner, and density of said elastic components at the middle position is lower than that of said elastic components at the perimeter of the plate.

11. The die casting machine of claim 8, wherein, a dust guard plate is provided between said first base plate and said second base plate.

12. The die casting machine of claim 8, wherein said second deformation compensation device is mounted inside a sliding seat, said second deformation compensation device is located on inner side of said sliding seat, said first base plate is in fixed connection with said moving die plate; and under the action of driving device, said sliding seat is operable for rendering said moving die plate to move towards or away from said fixed die plate.

13. The die casting machine of claim 8, wherein, said moving die device also comprises a rapid pressurization and pressure relief device for pressurizing and relieving the pressure on said elastic components.

14. The die casting machine of claim 13, wherein, said rapid pressurization and pressure relief device comprises a driving mechanism for driving the rotation of said screw bolt, an moving block and a driving block, provided between said moving die plate and an end part of said screw bolt and connected with each other;

said moving block and said screw bolt are circumferentially fixed with each other in a position-limited manner or integrally formed;

said driving block and said moving die plate are circumferentially fixed with each other in a position-limited manner or integrally formed;

said moving block and said driving block have an protrusion and a groove arranged therebetween, which coordinate with each other;

said driving mechanism is adapted for driving the rotation of said screw bolt, which further drives said moving block to slide relative to said driving block, in order to allow said protrusion to push said screw bolt to extrude said first base plate, when said protrusion slides out of said groove; and said protrusion adapted for relieving the extrusion to said first base plate, when said protrusion slides into said grooves.

15. The die casting machine of claim 14, wherein, said driving mechanism comprises a gear fixed on said screw bolt, a gear rack coordinating with said gear and adapted for pushing said gear to rotate forward and backward; and said gear rack is connected with a driving device.

16. The die casting machine of claim 14, wherein, one end of said moving block is circumferentially fixed on one end part of said screw bolt in a position limited manner, the other end of said moving block have said groove formed thereon, a cross-section of said grooves is a trapezium, and said protrusions is a trapezium-shaped protrusion; the rotation of said screw bolt drives trapezium-shaped said grooves to slide along an inclined plane of trapezium-shaped said protrusion.

17. The die casting machine of claim 8, wherein, said frame has a track formed on a side thereof, on which said moving die device is mounted; said mould clamping device is in fixed connection with or integrally formed with said moving die device and operable for locking said moving die device on said track.

18. The die casting machine of claim 17, wherein, said mould clamping device comprise mould clamping cavities, respectively located at both sides of said tracks and formed on said sliding seat; and each said mould clamping cavity has a locking wedge block and a pushing wedge block located at the inner side thereof; each said locking wedge block is provided close to said track, each said pushing wedge block is located between said locking wedge block and inner side of said mould clamping cavity; under the actuation of said mould clamping drive mechanism, each said pushing wedge block is operable for pushing said locking wedge blocks both sides of said tracks to clamp said track.

19. The die casting machine of claim 18, wherein, said mould clamping drive mechanism is an air cylinder or an oil cylinder, said air cylinder or said oil cylinder has two driving ends with opposite driving direction, said air cylinder or said oil cylinder is provided between said mould clamping device beneath said supporting plate and said mould clamping device beneath said sliding seat; two said driving ends are respectively connected with said pushing wedge blocks on two said mould clamping devices; when the driving ends of said air cylinder or said oil cylinder are refracted, said driving ends drive said pushing wedge block pushes said locking wedge block to realize mould clamping; when the driving end of said air cylinder or said oil cylinder is pushed out, locking of said moving die device is relieved.

20. The die casting machine of claim 17, wherein, said sliding seat has a supporting plate provided on a side thereof, which is away from said moving die plate; said supporting plate is located above said track; and said supporting plate and said sliding seat respectively have one said mould clamping device provided at the bottom thereof;

two said mould clamping devices are adapted for being driven by one said mould clamping drive mechanism.

* * * * *